US006446612B1

(12) United States Patent
Hankins et al.

(10) Patent No.: US 6,446,612 B1
(45) Date of Patent: Sep. 10, 2002

(54) FUEL INJECTION SYSTEM, COMPONENTS THEREFOR AND METHODS OF MAKING THE SAME

(76) Inventors: James Dwayne Hankins, 19981 Hwy. Z, Everton, MO (US) 65646; Roy M. Wood, Rte. 1, Box 18, Ash Grove, MO (US) 65604

( * ) Notice: Subject to any disclaimer, the term of this patent is extended or adjusted under 35 U.S.C. 154(b) by 16 days.

(21) Appl. No.: 09/800,251

(22) Filed: Mar. 5, 2001

Related U.S. Application Data

(60) Provisional application No. 60/243,262, filed on Oct. 25, 2000.

(51) Int. Cl.[7] ..... F02M 37/04
(52) U.S. Cl. ..... 123/514; 123/459
(58) Field of Search ..... 123/459, 464, 123/510, 514, 541

(56) References Cited

U.S. PATENT DOCUMENTS

| | | | | |
|---|---|---|---|---|
| 4,222,713 A | | 9/1980 | DeKeyser et al. | |
| 4,267,977 A | | 5/1981 | Stockner et al. | |
| 4,385,615 A | | 5/1983 | Keane | |
| 4,522,177 A | | 6/1985 | Kawai et al. | |
| 4,557,237 A | | 12/1985 | Bally et al. | |
| 4,872,438 A | | 10/1989 | Ausiello et al. | |
| 4,926,829 A | | 5/1990 | Tuckey | |
| 5,035,223 A | * | 7/1991 | Watanabe | 123/459 |
| 5,085,198 A | * | 2/1992 | Bartlett et al. | 123/510 |
| 5,685,278 A | * | 11/1997 | Bradford et al. | 123/514 |
| 5,765,537 A | * | 6/1998 | Coleman et al. | 123/514 |
| 5,832,902 A | * | 11/1998 | Davis et al. | 123/514 |
| 5,865,158 A | | 2/1999 | Cleveland et al. | |

* cited by examiner

*Primary Examiner*—Tony M. Argenbright
(74) *Attorney, Agent, or Firm*—Richard L. Marsh

(57) ABSTRACT

A method and apparatus to increase the fuel economy of a diesel engine having an injection system fuel rail by increasing the flow rate of fuel being returned to the tank hence decreasing the temperature of the fuel returned to the tank from the fuel rail while maintaining a given pressure at the fuel rail.

18 Claims, 2 Drawing Sheets

FUEL INJECTION SYSTEM, COMPONENTS THEREFOR AND METHODS OF MAKING THE SAME

RELATED APPLICATION DATA

This application is a non-provisional application of provisional application No. 60/243,262 filed on Oct. 25, 2000 by the joint inventors of this application.

BACKGROUND OF THE INVENTION

1. Field of the Invention

This invention relates to a fuel injection system for an internal combustion engine and improvement of the fuel economy thereof 2. Prior Art Statement It is known that cooling of the fuel injector assures proper functioning of the injector and that by moving a sufficient amount of fluid through a passage adjacent the injector provides a cooling effect, however, Stockner, et al., in their the U.S. Pat. No. 4,267,977 admit that auxiliary cooling such as a heat exchanger may be needed in the return line to supplement cooling.

It has long been recognized that fuel injected engines consume a lower amount of fuel and operate more smoothly when the fuel temperature to the injectors is controlled and more specifically when the temperature of the fuel at the injector is kept below 50° C. (120° F.). For instance, DeKeyser, et al., U.S. Pat. No. 4,222,713 issued on Sep. 16, 1980, recognized that power loss occurs at a fuel temperature above 50° C. (120° F.) as the fuel mass changes inversely with temperature. DeKeyser, et al., thus increase the amount of fuel injected with increased temperature by varying the injector pumping stroke length using a bellows responsive to fuel temperature.

Robert S. Keane, in his U.S. Pat. No. 4,385,615 issued on May 31, 1983 states that horsepower output of Cummins engines decreases by 1% with each 10° F. (5.5° C.) rise in temperature above 94° F. (34.4° C.). Keane further states that Cummins engines operate best with a fuel temperature in the range from about 94° F.–104° F. (34.4–40° C.) and therefore provides an auxiliary fuel tank oflimited volume for receiving return flow from the injectors of the engine wherein the auxiliary fuel tank may be heated or cooled to maintain the fuel fed to the injectors in the desired temperature range.

Auxiliary temperature control systems for fuel being returned to the tank are also known. For instance, in the U.S. Pat. No. 4,872,438 issued on Oct. 10, 1989, Ausiello, et al., senses the temperature of the fuel in the supply circuit downstream of the pump and provides for cooling of fuel being returned to the tank in response to signals provide by the temperature sensor. Ausiello, et al., also provide means for returning a portion of the pump output to the inlet of the pump through a branch line to increase fuel temperature.

Kawai, et al., U.S. Pat. No. 4,522,177, issued on Jun. 11, 1985, also recognized that the quantity of fuel injected decreases with a rise in fuel temperature and therefore compensate for the decreased fuel supply by providing means for increasing the quantity of fuel supplied by the fuel supply means when the temperature of the fuel in the fuel supply line to the injectors is greater than 40° C. (104° F.) but does not address increasing the flow of fuel returned to the fuel tank when the supply volume is already sufficient.

Charles Tuckey, in his U.S. Pat. No. 4,926,829 issued on May 22, 1990, detects the flow of fuel through the return line and adjusts the pump output volume as an inverse function of the return fuel flow. Thus, although Tuckey reduces the amount of heated fuel returned to the tank, the temperature of the returned fuel is most likely higher.

To provide for a substantially even horsepower output from each cylinder in a Caterpillar 3406E diesel engine, Cleveland, et al., in the U.S. Pat. No. 5,865,158 issued on Feb. 2, 1999 adjust the pulse width at each injector based on a calculated temperature at each injector. The calculated temperature is a linear extrapolation of the difference between the outlet temperature and the inlet temperature of the fuel rail.

Those skilled in the art also know that voids or gas bubbles in high pressure fuel systems hamper the injection of fuel to the combustion chambers. Bally, et al., in U.S. Pat. No. 4,577,237 issued on Dec. 10, 1985 control cavitation within the high pressure injection pump by providing a spill passage for communicating a bypass port with a low pressure chamber of the pump to flush out entrained air prior to the next pump stroke. Keane, in the aforementioned U.S. Pat. No. 4,385,615, maintains the level of fluid in the auxiliary tank at the same level as the pump to reduce entrained air.

Finally, the inventors of the instant invention have previously increased horsepower output of truck engines using a fuel rail system where each injector is fed by an individual injector pump by increasing the diameter of an orifice in the fuel system return line and increasing the fuel volume flowing through the fuel rail thereby increasing the volume flow of fuel returned to the fuel tank that also resulted in a decreased temperature of the returned fuel.

SUMMARY OF THE INVENTION

The aforementioned prior art described certain methodologies of cooling returned fuel for the purposes of cooling injectors or increasing horsepower in fuel injected engines, however, the synergy between increased fuel return flow at an adequate supply volume, decreased fuel temperature, decreased fuel aeration and increased horsepower while maintaining sufficient pressure at the fuel rail has not been recognized.

Therefore, it is an object of this invention to decrease the temperature of the fuel returned to the tank from an injection system fuel rail while maintaining a given pressure at the fuel rail.

It is also an object of this invention to decrease the temperature of the fuel returned to the tank from an injection system fuel rail by increasing the flow rate of fuel being returned to the tank.

Yet a further object of this invention is to increase the flow through the fuel rail back pressure valve by increasing the inlet diameter of the back pressure valve.

Still a further object of this invention is to increase the flow through the fuel rail back pressure valve by increasing the diameter of the outlet holes in the back pressure valve.

A principal object of this invention is to increase the fuel economy of a diesel engine having an injection fuel rail by increasing the amount of fuel returned to the fuel tank from the fuel rail.

A significant object of this invention is to increase the fuel economy of a Caterpillar 3406E series diesel engine up to 10 percent.

Another significant object of this invention is to increase the fuel economy of a diesel engine having an injection fuel rail by decreasing the fuel temperature in the tank and hence the fuel temperature at the inlet of the fuel rail.

Still another significant object of this invention is to increase the fuel economy of a diesel engine having an injection fuel rail by returning sufficient fuel to the tank to maintain a temperature in the fuel tank at substantially ambient temperature.

Yet another principal object of this invention is to increase the fuel economy of a diesel engine having an injection fuel rail by decreasing the amount of fuel aeration at each injector successive to the first injector by increasing the mass flow through the fuel rail.

It will be recognized that another object of this invention is to increase horsepower and fuel economy in a diesel engine having an injection fuel rail using the synergistic effect of increasing fuel return flow to the tank, decreasing fuel temperature of the returned fuel while maintaining sufficient pressure in the fuel rail.

Additionally, it will be recognized that another object of this invention is to increase horsepower and fuel economy in a diesel engine having an injection fuel rail using the synergistic effect of increasing fuel return flow to the tank, decreasing fuel aeration at successive injectors after the first injector, substantially maintaining a constant fuel temperature to the inlet of the injection rail while maintaining sufficient pressure in the fuel rail.

Other objects of this invention will become readily apparent upon a reading of the following specification and reference to the drawings made a part hereof

DESCRIPTION OF THE PREFERRED EMBODIMENTS

While the various features of this invention are hereinafter described and illustrated as method and apparatus to increase horsepower in a diesel engine having an injection fuel rail using the synergistic effect of increasing fuel return flow to the tank, decreasing fuel temperature of the returned fuel while maintaining sufficient pressure in the fuel rail it is to be understood that the various features of this invention can be used singly or in various combinations thereof to increase the flow through the fuel rail back pressure valve in order to increase fuel economy and/or decrease fuel temperature as can hereinafter be appreciated from a reading of the following description.

Figure 1:
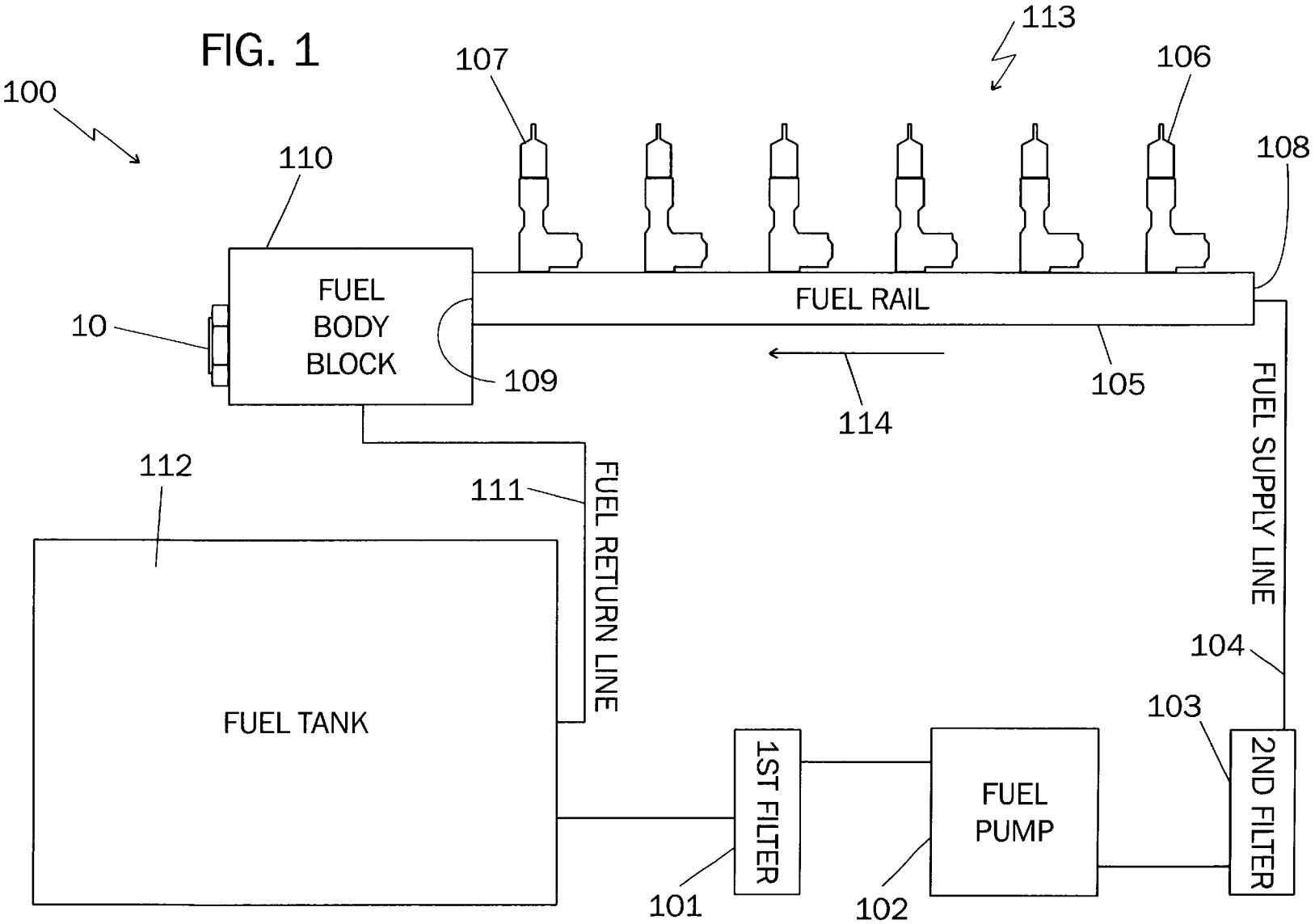
FIG. 1 is a layout of a fuel injection system of a diesel engine.

Referring now to FIG. 1, a direct injection internal combustion engine generally has fuel supplied to the cylinders through a fuel injection system 100 wherein a fuel supply pump 102 draws fuel from a fuel tank 112, supplies the fuel at a given pressure but at excess volume to a fuel rail 105 and returns unused fuel to tank 112 through a fuel return line 111. Fuel rail 105 has injectors 113 for each cylinder of the internal combustion engine associated therewith, six such injectors shown in FIG. 1 wherein a first injector 106 is defined as the injector 113 on fuel rail 105 closest to an inlet end 108 of fuel rail 105 and hence injector 106 receives fuel from fuel pump 102 first. A last injector 107 is defined as the injector 113 on fuel rail 105 closest to an outlet end 109 and hence is the last injector 113 on fuel rail 105 to receive fuel through fuel system 100 as fuel flows through fuel rail 105 in direction from right to left as shown by direction arrow 114. Typically, fuel supply pump 102 is a positive displacement pump, such as a gear pump, which draws fuel from tank 112 through primary fuel filter/strainer 101, raises the pressure of the fuel in fuel system 100 from ambient conditions and pumps the fuel through secondary filter 103 and fuel supply line 104 toward fuel rail 105. Injectors 113 on fuel rail 105 receive fuel at a substantially constant pressure but varying volume and therefore as the engine load increases and hence fuel consumption increases, an excess of fuel flow is required in fuel rail 105 to ensure a constant supply of fuel to each injector 113. Pressure is maintained in fuel rail 105 by a back pressure valve 10 installed in a fuel body block 110 wherein fuel body block 110 may be integral with outlet end 109 of fuel rail 105 however, fuel body block 110 may also be disposed remote from said fuel rail 105 and on the aforementioned Caterpillar 3406E diesel engine is generally disposed below exit end 109 of fuel rail 105 on the block of the diesel engine. Therefore, back pressure valve 10 must maintain pressure in fuel rail 105 while permitting the unused amount of excess fuel to return to fuel tank 112. In the aforementioned Caterpillar 3406E diesel engine, back pressure valve 10 maintains fuel pressure in fuel rail 105 at approximately one hundred pounds per square inch (100 psi) while permitting more than sixty gallons per hour of fuel to flow therethrough as well as through fuel return line 111 back to fuel tank 112. As injectors 113 on fuel rail 105 are cooled by the flow fuel through rail 105, the temperature of the fuel passing through rail 105 increases as is well known and previously described in the prior art. Hence, the temperature of fuel in tank 112 also continues to rise especially in hot environments during the summer months and in regions of the world where the ambient temperature is elevated so that the temperature of the fuel supplied to fuel rail 105 is also elevated. It is not unusual for the temperature at fuel rail 105 to approach 165° F. (73.9° C.), a maximum operating fuel temperature programmed into the electronic control module (ECM) of the engine. The increasing temperature of fuel being supplied to fuel rail 105 of this engine results in severe loss of power and a requisite drop in fuel economy.

Figure 2:
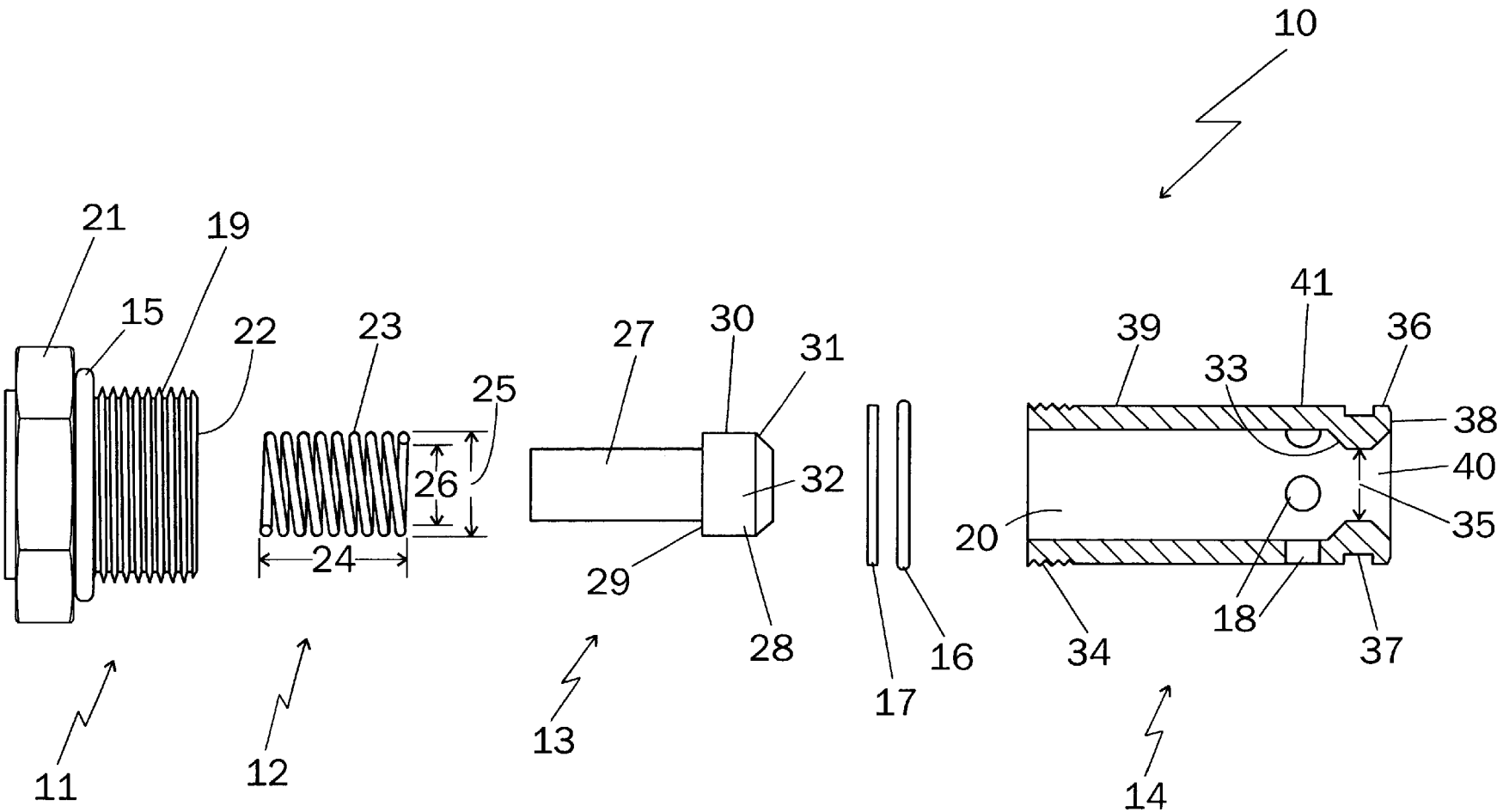
FIG. 2 is an exploded view, partially in cross section, of the elements of the fuel rail back pressure valve in FIG. 1.

Referring now to FIG. 2, back pressure valve 10 comprises a piston 13 biased against a conical seat 33 in an inlet nut 14, inlet nut 14 threadedly engaged with a body 11. Piston 13 is telescopically received in the inside diameter 26 of a spring 12 wherein spring 12 and piston 13 are telescopically received in a bore 20 of inlet nut 14 and captured therewithin when inlet nut 14 is threadedly engaged in body 11. Spring 12 comprises a series of coils of spring wire 23, spring 12 having a spring constant such that length 24 provides sufficient force to piston 13 against conical seat 33 that back pressure valve 10 maintains the requisite pressure in fuel rail 105. Specifically, in back pressure valve 10 used in the aforementioned Caterpillar 3406E diesel engine, the spring constant of spring 12 is about 7.2 pounds per inch when piston seat 31 is seated against conical seat 33 as the throat diameter 35 of an inlet port 40 of inlet nut 14 is 0.3031 inch. As is readily apparent, fuel flows through back pressure valve 10 from inlet port 40 through throat 35, outwardly along tapered piston seat 31, along outer peripheral surface 30 of piston head 28 and out relief holes 18 bored through barrel 39 of inlet nut 14. As back pressure valve 10 is installed in a passage within fuel body block 110 and the return fuel flows at right angles through back pressure valve 10, shrouding around a portion of barrel 39 in fuel block 110 may inhibit flow from some of relief holes 18 and thus the sum of the surface areas of relief holes 18 is typically greater than the surface area of inlet port 40. For instance, in the stock back pressure valve 10 in the aforementioned Caterpillar 3406E diesel engine, each of relief holes 18 is 0.1654 inch in diameter and hence the total area through five relief holes 18 is 0.1074 square inches whereas the surface area of inlet port 40 is 0.0722 square inches. Thus, the sum of the area of five relief holes 18 is nearly 50 percent greater than the surface area through inlet port 40 whereas the sum of the area of six relief holes 18 used in some later back pressure valves 10 used in Caterpillar 3406E diesel engines is more than 70 percent greater than the area of inlet port 40. It has been found by the inventors hereof that this increase in surface area of the relief holes does not achieve the results that the instant invention achieves as the return fuel flow to the tank is not increased significantly by increasing the outlet relief hole area. Though piston 13 has been recited to be disposed within spring 12, spring 12 could be as easily received in a bore within piston 13 or other means of providing a biasing force for piston 13 could be employed.

An O-ring 15 is provided on body 11 adjacent head 21 to seal back pressure valve against fuel body block 110. Similarly, a sealing ring 16 with a backing washer 17 is provided adjacent peripheral surface 36 of inlet nut 14 to seal inlet end 38 of back pressure valve 10 from outlet side 41 in the internal passage in fuel body block 110. Sealing ring 16 and backing washer 17 fit in a sealing groove 37 formed into peripheral surface 36 adjacent inlet end 38. Back pressure valve 10 is assembled by placing piston stem 27 into internal diameter 26 of spring 12 with one end of spring 12 bearing against a spring shoulder 29 formed on 32 of piston 13, telescopically disposing spring 12 and piston 13 into bore 20 of barrel 39 of inlet nut 14 and thereafter threadedly engaging threads 34 of barrel 39 into internal threads 22 of body 11. Sealing ring 15 is then telescopically disposed over the assembled back pressure valve 10 and installed adjacent hex head end 21 of body 11. Similarly, sealing ring 16 is disposed in sealing groove 37 with backing washer 17 installed in sealing groove 37 in the portion of groove 37 toward hex head nut 21. Backing washer 17 is a split ring washer of Teflon®, a registered trademark of DuPont. Having described the back pressure valve 10 used in fuel rail injection systems of the prior art, the novel features of this invention will be hereinafter fully explained.

Still referring to FIG. 2, it has been found by the inventors hereof, that by increasing inlet diameter 35 of inlet port 40 of back pressure valve 10, fuel flow is substantially increased thereby passing a greater amount of fuel by the injectors 113 of fuel rail 105 while maintaining sufficient back pressure in fuel rail 105. It has also been found that the increased mass flow rate of fuel through the larger inlet port 40 decreases the temperature of the fuel returned to tank 112 from injection system fuel rail 105 while increasing the spring constant of spring 13 maintains a given pressure at fuel rail 105. The increase in the flow through fuel rail back pressure valve 10 also results in an increased mass flow rate of fuel being returned to the tank which assists in keeping the temperature in tank 112 lower and thus assists to increase the fuel economy of a diesel engine having injection fuel rail 105 by increasing the amount of fuel returned to fuel tank 112 from fuel rail 105. Since the temperature in tank 112 is lower, the greater mass flow rate of fuel increases the fuel economy of a diesel engine having injection fuel rail 105 by decreasing the fuel temperature in tank 112 and hence the fuel temperature at inlet end 108 of fuel rail 105 as the cooler fuel being presented to injectors 113 thereby maintains a cooler injector tip and a cooler fuel being injected into the cylinders of the internal combustion engine. The increased mass flow of fuel to tank 112 has been found to maintain a temperature in fuel tank 112 at substantially ambient temperature.

Specifically, the teachings of this invention have shown that in test runs using a back pressure valve 10 having a greater throat diameter 35 of inlet port 40 have resulted in a decrease of about 10° F. in fuel returned to tank 112 thus increasing the fuel economy of the aforementioned Caterpillar 3406E diesel engine in an over the road tractor trailer truck over a short test run. Referring now to Table 1 below, in initial test runs using a tractor trailer truck having a stock back pressure valve 10 installed in the diesel engine therein, the beginning temperature (69° F.) in fuel tank 112 was slightly above ambient temperature (63° F.) and climbed to a temperature of (80° F.) during the round trip of 40.3 miles. On the second round trip over the same test course in the same ambient conditions wherein the tractor trailer truck having the back pressure valve 10 of this invention installed in the engine thereof, the temperature in fuel tank 112 was (80° F.) at the beginning but dropped to a temperature of (71° F.) during the test run. Still referring to Table 1, it is noted that the temperature of returning fuel to tank 112 of a tractor trailer truck with a load factor of 46% having a stock back pressure valve 10 installed therein when driven 40.3 miles on a test run was 100° F. at the conclusion of the run as compared with a temperature of at least 100° F. at the beginning of the run in an ambient temperature in the low 80's. The same vehicle with the same load factor in the same ambient conditions, immediately after the test run with the stock valve and after having a back pressure valve 10 of this invention having a greater throat diameter 35 of inlet port 40 installed in fuel body block 110, had a beginning fuel tank 112 temperature of approximately 100° F. and after the test run over the same test course had a fuel tank temperature of approximately 89° F., an 11° F. drop in temperature.

The instant inventors have also found that the greater mass flow of fuel through fuel rail 105 results in a smoother engine operation by moving air entrained fuel away from subsequent injectors 113 along fuel rail 105 from first injector 106 to last injector 107 and thereby increasing the fuel economy of a diesel engine by decreasing the amount of fuel aeration at each injector 113 successive to the first injector 106 by the increased mass flow rate of fuel through fuel rail 105. In a diesel engine, a minor amount of fuel supplied to injectors 113 from fuel rail 105 is actually injected into the cylinders of the engine, for instance, as is stated in the aforementioned patent to Keane, only about one fourth of the fuel supplied to injector rail 105 is used though some of the fuel admitted to each of injectors 113 is immediately returned to fuel rail 105 through a bypass in injector 113. The injector of modern diesel engines is actuated by an electronic signal from the ECM and builds pressure in the injector hydraulically using a rocker arm actuated by an engine driven camshaft prior to the injection signal. The bypassed fuel is typically at the extremely elevated pressure of injector 113 and return thereof to fuel rail 105 causes cavitation in the fuel thereby entrapping air in fuel rail 105. At the lower flow rate of fuel through fuel rail 105 using a stock back pressure valve 10, the entrained air generated at first injector 106 is carried downstream in the direction of arrow 114 to at least one subsequent injector 113. With entrained air in the fuel admitted to each subsequent injector 113, hydraulic pressure builds slower thereby potentially decreasing the mass of fuel available to be injected into that cylinder and may cause that cylinder to fail to produce a full power stroke output to the crankshaft of the engine, especially at high power need or at high speed. In addition, cavitation of the bypassed fuel from each injector 113 adds to the amount of entrained air in fuel rail 105 thereby adding to the amount of entrained air that can be admitted to each subsequent injector 113 such that at last injector 107, the amount of air entrained in the fuel in fuel rail 105 may be sufficient to cause injector 107 to totally misfire and certainly causes injector 107 to fail to produce a full power stroke output to the crankshaft of the engine whereby a loss in horsepower output is observed. The firing of all the cylinders in a diesel engine create a certain sound and such a misfiring causes the operation of the engine to be slightly altered which is readily observed by the operator of the vehicle having the engine installed therein. For instance, immediately after the installation of the type I back pressure valve 10 of this invention at the beginning of the initial test run, the operator of the vehicle remarked that the engine had a smoother sound and the exhaust sounded richer. It is believed by the inventors of this invention that the smoother sound is a result of moving a greater amount of entrained air away through moving an increased mass rate of flow of fuel from each of successive injectors 113 after injector 106 such that misfiring as a result of entrained air in the injected fuel has been significantly reduced. Though attempts have been made to alter the pulse width of the electronic injection signal to compensate for the temperature increase of fuel in fuel rail 105 as is fully explained in the aforementioned U.S. Pat. No. 5,865,158, no compensation has been made for the amount of entrained air in the fuel. Thus, it is significant that by increasing the mass rate of fuel flow through injection rail 105 by increasing the throat diameter 35 of inlet port 40, movement of entrained air through fuel rail 105 has resulted in smoother operation of diesel engines.

Specifically, the teachings of this invention have shown that in test runs using a back pressure valve 10 having a greater throat diameter 35 of inlet port 40 have resulted in an increase of up to 10 percent in fuel economy of the aforementioned Caterpillar 3406E diesel engine in an over the road tractor trailer truck. Referring also to Table 1, it is noted that the fuel economy of a tractor trailer truck with a load factor of 46% having a stock back pressure valve 10 installed therein when driven 40.3 miles on a test run was 5.12 miles per gallon of fuel at an average driving speed of 53.7 miles per hour. The same vehicle with the same load factor, after having a back pressure valve 10 of this invention having a greater throat diameter 35 of inlet port 40 installed in fuel body block 110, had a fuel economy of 5.21 miles per gallon over the same test course run at an average driving speed of 57.7. As the average driving speed over the same test course was increased by 4 miles per hour, it is clear that the horsepower output of the engine in the vehicle also was improved upon installation of back pressure valve 10 of this invention. Referring now to the more than 90,000 mile extended test of the back pressure valve 10 of this invention shown in Table 1, it is noted that the fuel economy of the same vehicle used in the test runs improved to 5.45 miles per gallon at an average driving speed of 58.1 miles per hour. Thus, an increase in the fuel economy of a Caterpillar 3406E series diesel engine has been improved by greater than 6 percent and the horsepower output thereof also improved as is evidenced by the average driving speed. It is clear here that not only is the fuel economy improved but that the horsepower output is increased wherein the combination of the two leads to greater efficiency as well as lower cost of operation of the tractor trailer truck.

Initially, in the first test runs, the vehicle used was relatively new having only about 16000 miles on the engine with the Over the Road Truck (OTR) run occurring after the 1st test runs while the second test runs were conducted after the OTR run where the tractor had approximately 106,000 miles on the odometer.

TABLE 1

| Valve | ° F. ambient | ° F. start | ° F. end | mpg | miles driven | speed speed | load factor |
|---|---|---|---|---|---|---|---|
| Stock | | | | | | | |
| 1st test | 63 | 69 | 80 | NR | 40.3 | NR | NR |
| 2nd test | ~85 | <100 | 100 | 5.12 | 40.3 | 53.7 | 46% |
| Type I | | | | | | | |
| 1st test | 63 | 80 | 71 | NR | 40.3 | NR | NR |
| 2nd test | ~85 | 100 | 89 | 5.21 | 40.3 | 57.7 | 46% |
| Type I | | | | | | | |
| OTR | vary | NR | NR | 5.45 | 90,384 | 58.1 | 34% |

NR = not recorded

According to the teachings of this invention, in order to increase the flow through fuel rail back pressure valve 105, the type I back pressure valve 10 of this invention has throat diameter 35 of inlet port 40 increased to 0.3125 inch from 0.3031 inch, thereby enlarging the throat area of inlet port 40 to 0.0767 square inches and additionally had relief holes 18 enlarged to 0.1718 inch from 0.1069 inch, resulting in a total surface area of the five relief holes 18 being 0.1159 square inches. Thus the increase in flow through fuel rail back pressure valve 10 by enlarging the throat area of inlet port 40 and increasing the diameter of outlet holes 18 in back pressure valve 10 substantially maintains the 50 percent additional surface area of exit holes 18. In order to maintain a back pressure of 100 psi in fuel rail 105, it would be necessary to increase the length of spring 13 thereby changing the spring constant. Thus, in this example, the spring constant of spring 13 would need to be altered to approximately 7.7 from 7.2 pounds per inch.

Similarly, a type II back pressure valve 10 has throat diameter 35 enlarged to 0.328125 inch thereby enlarging the throat area of inlet port 40 to 0.0845 square inches and additionally had relief holes 18 enlarged to 0.1875 inch resulting in a total surface area of the five relief holes 18 being 0.1381 square inches. Thus the increase in flow through fuel rail back pressure valve 10 by enlarging the throat area of inlet port 40 and increasing the diameter of outlet holes 18 in back pressure valve 10 more than maintains the 50 percent additional surface area of exit holes 18. Again, for example, in order to maintain a back pressure of 100 psi in fuel rail 105, it would be necessary to increase the length of spring 13 thereby changing the spring constant. Thus, the spring constant of spring 13 would need to be altered to approximately 8.5 pounds per inch. Though spring 12 has had the length thereof altered, it is fully understood that other means of altering the spring constant of spring 12 may be used to accomplish the purpose of maintaining back pressure in fuel rail at 100 psi. The operator of an OTR tractor trailer truck having a type II valve installed therein has reported a substantial increase in horsepower, however, the fuel economy results have not been manually recorded but will be retrieved from the engine ECM upon completion of the OTR run.

Considering the above noted results of test runs and the OTR run using back pressure valve 10 of this invention, it is clear that the temperature in fuel tank 112 decreases by approximately 10° F., the horsepower of the engine in the tractor trailer truck improves as is evidenced by the increase in average driving speed, the injection of aerated fuel has been decreased and the operating conditions of the engine improve as noted by the smoother running sound reported by the operator and the fuel economy has been improved by at least 0.33 miles per gallon. As an increase in average driving speed may result in operating the vehicle over a greater distance within the same legal driving time, efficiency of the vehicle is increased. For instance, the 4 miles per hour increase in speed would result in 32 more miles for an 8-hour day and it is believed by the inventors hereof that an increase of up to 75 miles per day may be realized with the combined increase in horsepower and speed. Thus, it has been found to increase horsepower and fuel economy in a diesel engine having injection fuel rail 105 with the synergistic effect of increasing fuel return flow to tank 112, decreasing fuel aeration at successive injectors 113 after first injector 106, substantially maintaining a constant fuel temperature to the inlet 108 of injection rail 105 while maintaining sufficient pressure in the fuel rail 105.

Though the test runs and the OTR run have been conducted on only one engine, specifically a Caterpillar C15 series diesel engine installed in an OTR tractor trailer truck, other Caterpillar diesel engines, such as the C12, E-model and C16 series diesel engines, use the same back pressure valve. A back pressure valve such as installed in fuel body block 110 of the aforementioned Caterpillar diesel engine is typically used in other OTR vehicles which are powered by diesel engines however, the back pressure valve is typically disposed distantly remote from the end of the fuel rail and may be disposed adjacent the supply tank. It is believed though, that the design of this inline back pressure valve is substantially the same as the back pressure valve used in the aforementioned Caterpillar diesel engine and hence may be readily replaced by the back pressure valve 10 of this invention. Thus, it is believed by the inventors hereof that back pressure valve 10 of this invention may be used in other OTR vehicles to achieve significant increases in performance and decreased fuel consumption as have been herein recited for the Caterpillar engines. The inventors of back pressure valve 10 of this invention are also familiar with certain off road vehicles used in construction, mining and manufacturing as well as rail borne vehicles such as train engines that use a fuel injection rail system will benefit from the teachings of this invention. Thus it is believed by the inventors of back pressure valve 10 of this invention that installation thereof in the engines having fuel injection rail systems therein will result in a significant decrease in the consumption of the world's petroleum resources as well as increase the power output of the engines thereby increasing the efficiency and decreasing the cost of operation. Such an increase in efficiency and decrease in operating cost should also result in retention of independent operators.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

We claim:

1. A method of decreasing the temperature of fuel returned to the supply tank from a fuel injection rail of an internal combustion engine injection system, said fuel injection rail having an inlet end, a return end and a plurality of cylinder injection nozzles between said inlet end and said return end, said injection nozzles receiving fuel from said common fuel injection rail, the method comprising the steps of providing a supply line to said inlet end of said fuel rail, providing a return line to said supply tank from said return end of said fuel rail, supplying an adequate amount of fuel to said fuel rail from a fuel injection pump through said supply line, maintaining an adequate pressure within said fuel rail by disposing a back pressure valve in said return line, returning a portion of said fuel from said injection rail through said return line to said supply tank and increasing said portion of said fuel returned from said injection rail to said supply tank.

2. A method as in claim 1 wherein said step of maintaining said pressure within said fuel rail includes the step of increasing the spring rate of a spring within said back pressure valve, said spring holding a movable valve member against a seat in said throat of said back pressure valve.

3. A method as in claim 1 wherein said step of increasing said portion of said fuel returned to said supply tank includes the step of increasing the area of the inlet end of said back pressure valve by increasing the diameter of the throat thereof.

4. A method as in claim 3 wherein said area of said throat of said back pressure valve is increased from about 0.5 percent to about 25 percent.

5. A method as in claim 4 wherein said area of said throat of said back pressure valve is increased about 6.0 percent.

6. A method as in claim 3 wherein said step of increasing said diameter of said inlet end of said back pressure valve increases the mass rate of fuel flow through said fuel rail thereby providing a greater mass rate of fuel flow to provide greater cooling of said injectors.

7. A method as in claim 3 wherein said step of increasing said flow through said fuel rail back pressure valve includes the further step of increasing the diameter of the outlet ports in said back pressure valve.

8. A method as in claim 7 wherein said area of said outlet ports of said back pressure valve is increased from about 0.5 percent to about 25 percent.

9. A method of increasing the fuel economy of an internal combustion engine having an fuel injection rail, said fuel injection rail having an inlet end, a return end and a plurality of cylinder injection nozzles between said inlet end and said return end, said injection nozzles receiving fuel from said common fuel injection rail, the method comprising the steps of providing a supply line to said inlet end of said fuel rail, providing a return line to said supply tank from said return end of said fuel rail, supplying an adequate amount of fuel to said fuel rail from a fuel injection pump through said supply line, maintaining an adequate pressure within said fuel rail by disposing a back pressure valve in said return line, returning a portion of said fuel from said injection rail through said return line to said supply tank and decreasing the temperature of fuel returned to said supply tank from said fuel injection rail by increasing said portion of said fuel returned from said injection rail to said supply tank.

10. A method as in claim 9 wherein said step of decreasing the fuel temperature of fuel returned to said tank reduces the rise in fuel temperature in said supply tank.

11. A method as in claim 10 wherein decreased fuel temperature in said supply tank decreases the fuel temperature at said inlet end of said fuel rail, said decreased fuel temperature at said inlet end of said fuel rail further increasing said fuel economy.

12. A method as in claim 9 wherein said step of decreasing said temperature of said fuel returned to said supply tank maintains a temperature in said supply tank at substantially ambient temperature.

13. A method of increasing the fuel economy of an internal combustion engine having an fuel injection rail, said fuel injection rail having an inlet end, a return end and a plurality of cylinder injection nozzles between said inlet end and said return end, said injection nozzles receiving fuel from said common fuel injection rail, the method comprising the steps of providing a supply line to said inlet end of said fuel rail, providing a return line to said supply tank from said return end of said fuel rail, supplying an adequate amount of fuel to said fuel rail from a fuel injection pump through said supply line, maintaining an adequate pressure within said fuel rail by disposing a back pressure valve in said return line, returning a portion of said fuel from said injection rail through said return line to said supply tank, increasing said portion of said fuel returned from said injection rail to said supply tank, said step of increasing said portion of said fuel returned from said injection rail decreasing the amount of fuel aeration at each injector disposed on said fuel rail successive to a first injector disposed on said fuel rail by increasing the mass flow rate of fuel through said fuel rail.

14. A method as in claim 13 wherein said step of increasing said portion of said fuel returned to said supply tank includes the step of increasing the area of the inlet end of said back pressure valve by increasing the diameter of the throat thereof.

15. A method as in claim 14 wherein said area of said throat of said back pressure valve is increased from about 0.5 percent to about 25 percent.

16. A method as in claim 15 wherein said step of maintaining said pressure within said fuel rail includes the step of increasing the spring rate of a spring within said back pressure valve, said spring holding a movable valve member against a seat in said throat of said back pressure valve.

17. A method as in claim 13 wherein said step of increasing said mass rate of fuel flow through said fuel rail provides greater cooling of said injectors disposed in said fuel rail.

18. A method as in claim 13 wherein said step of increasing said flow through said fuel rail back pressure valve includes the further step of increasing the diameter of the outlet holes in said back pressure valve.

* * * * *